US007845437B2

(12) United States Patent
Bielawa et al.

(10) Patent No.: US 7,845,437 B2
(45) Date of Patent: Dec. 7, 2010

(54) HOLE OPENER ASSEMBLY AND A CONE ARM FORMING A PART THEREOF

(75) Inventors: Todd Bielawa, Hartland, WI (US); James Schulz, Sullivan, WI (US)

(73) Assignee: Century Products, Inc., Sussex, WI (US)

( * ) Notice: Subject to any disclaimer, the term of this patent is extended or adjusted under 35 U.S.C. 154(b) by 0 days.

(21) Appl. No.: 12/370,766

(22) Filed: Feb. 13, 2009

(65) Prior Publication Data

US 2010/0206638 A1 Aug. 19, 2010

(51) Int. Cl.
*E21B 10/26* (2006.01)
*E21B 10/20* (2006.01)

(52) U.S. Cl. ..... 175/413; 175/385; 175/367; 175/357

(58) Field of Classification Search ..... 175/385, 175/412, 413, 356, 366, 357, 367
See application file for complete search history.

(56) References Cited

U.S. PATENT DOCUMENTS 4,406,337 A * 9/1983 Dill ..... 175/426
4,445,580 A * 5/1984 Sahley ..... 175/404
4,700,790 A * 10/1987 Shirley ..... 175/428
5,224,560 A * 7/1993 Fernandez ..... 175/374
5,439,068 A * 8/1995 Huffstutler et al. ..... 175/356
5,595,255 A 1/1997 Huffstutler
5,624,002 A 4/1997 Huffstutler
5,641,029 A 6/1997 Beaton et al.
5,678,645 A * 10/1997 Tibbitts et al. ..... 175/426
5,906,245 A * 5/1999 Tibbitts et al. ..... 175/426
6,729,418 B2 * 5/2004 Slaughter et al. ..... 175/53
6,742,608 B2 6/2004 Murdoch
6,902,014 B1 * 6/2005 Estes ..... 175/266
7,025,155 B1 * 4/2006 Estes ..... 175/413
7,137,460 B2 * 11/2006 Slaughter et al. ..... 175/53
7,152,702 B1 * 12/2006 Bhome et al. ..... 175/384
7,341,119 B2 3/2008 Singh et al.
7,360,612 B2 4/2008 Chen et al.
7,458,430 B2 * 12/2008 Fyfe ..... 175/342
2006/0260848 A1 * 11/2006 Fyfe ..... 175/344
2010/0206638 A1 * 8/2010 Bielawa et al. ..... 175/356

* cited by examiner

*Primary Examiner*—Jennifer H Gay
(74) *Attorney, Agent, or Firm*—Quarles & Brady LLP

(57) ABSTRACT

An improved hole opener assembly for horizontal drilling is disclosed that is less prone to failure as a result of cone arm break out or pocket side wall fracture. The interface between the cone arm and the pocket employs a key and slot configuration with a tighter fit than between the arm and the pocket to reduce the stress on the pocket side wall during drilling.

13 Claims, 7 Drawing Sheets

HOLE OPENER ASSEMBLY AND A CONE ARM FORMING A PART THEREOF

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to hole openers for horizontal directional drilling. In particular, this invention relates to the attachment of cone arms to the bit body of hole openers.

During the installation of pipes, conduits, or other types of lines, it may be necessary to provide a horizontal pathway through areas that are not easily excavated. Such areas may include preexisting structures, environmentally sensitive areas, areas in which there is high traffic flow, and the like.

One method used to create a pathway without excavation is horizontal directional drilling. In horizontal directional drilling, a pilot hole is drilled along the pathway. After the pilot hole is drilled, a hole opener is pulled and/or pushed back through the pilot hole to enlarge the diameter of the hole to the desired size.

Typically, the hole opener includes a bit body with pockets to hold cone arms that perform the cutting action. Each of the cone arms include an arm secured into a corresponding pocket and further includes a cone head having the teeth formed thereon that cut the hole. Gaps between the pockets provide space for the rearward exit of debris.

Under the extreme stress of the drilling operation, cone arms can fracture from the bit body. In the event of such failure, the hole opener must be repaired. At a minimum, the repair requires replacement of the failed cone arm. However, in many cases, a wall of the pocket may fracture and this wall will need to be rebuilt. Thus, any cone arm failure or "break out" can be costly as the cone arm may need to be discarded or, if possible, repaired. This may result in substantial downtime, upsetting the construction schedule.

Hence, a need exists for an improved hole opener that is less prone to cone arm break out and pocket fracture.

SUMMARY OF THE INVENTION

An improved hole opener assembly is disclosed that is less prone to failure as a result of cone arm break out or pocket fracture. The hole opener assembly includes a bit body extending along a rotational axis. A plurality of pockets is formed in the bit body. Each of the pockets has a wall defining at least a portion of the pocket. The hole opener assembly further includes a plurality of cone arms each having an arm with an attached cone head. Each arm is mounted into one of the pockets to form an interface therebetween. At least one of the interfaces includes a slot formed in one of the pocket and the arm and a key formed in the other of the pocket and the arm. When the arm is inserted into the pocket, the key mates with the slot. The key and the slot have a tighter fit therebetween than between the arm and the pocket. Hence, a force exerted on the arm is initially transferred across the key and the slot to reduce the force transferred from the arm to the wall of the pocket.

Thus, the disclosed hole opener assembly reduces break out failures in which the cone arm fractures from the bit body. The reduction in these type of failures reduces likelihood of incurring the cost and the downtime associated with the rebuilding of failed hole openers.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Figure 1:
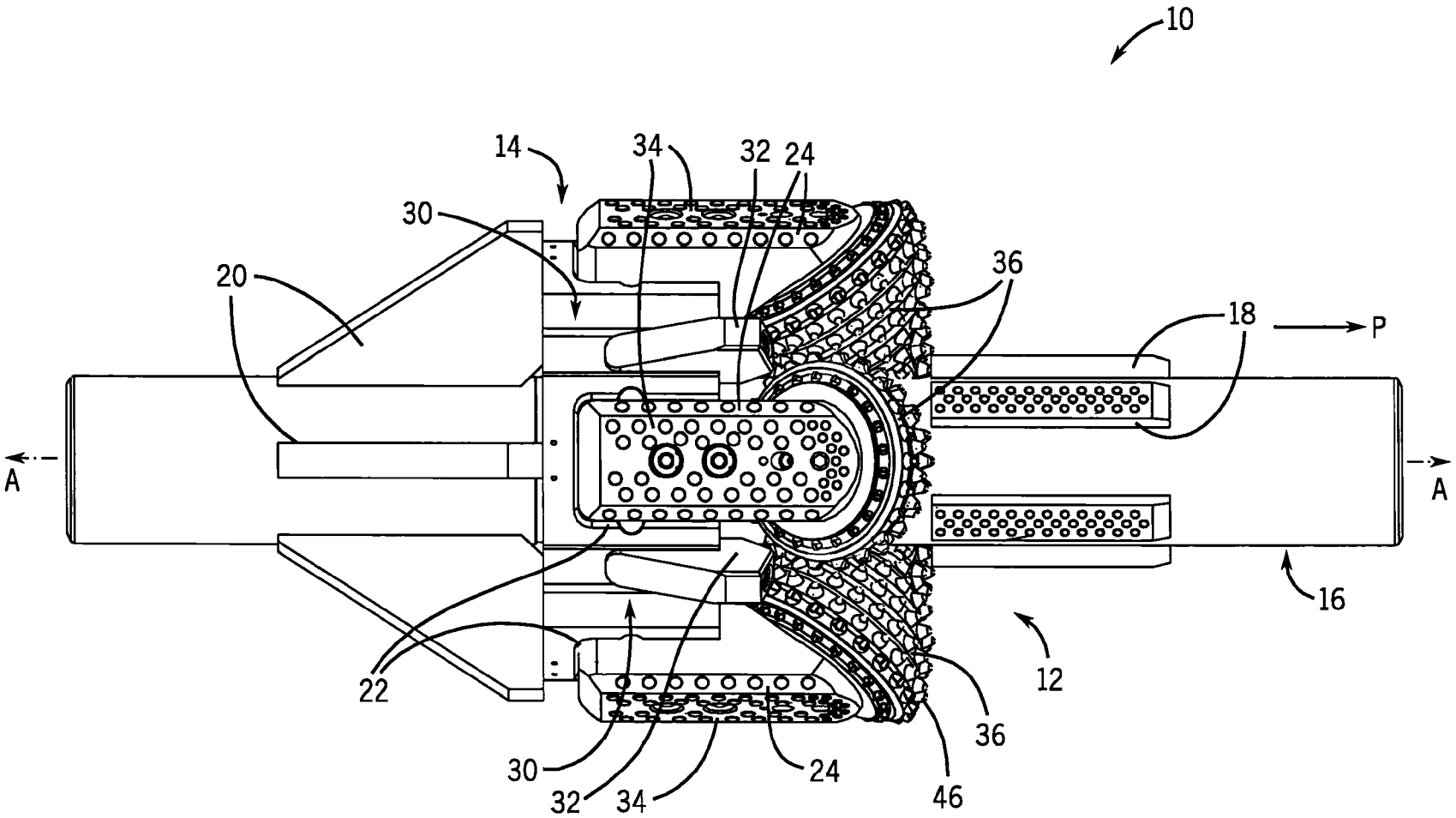
FIG. 1 is a side view of a hole opener assembly.
Figure 2:
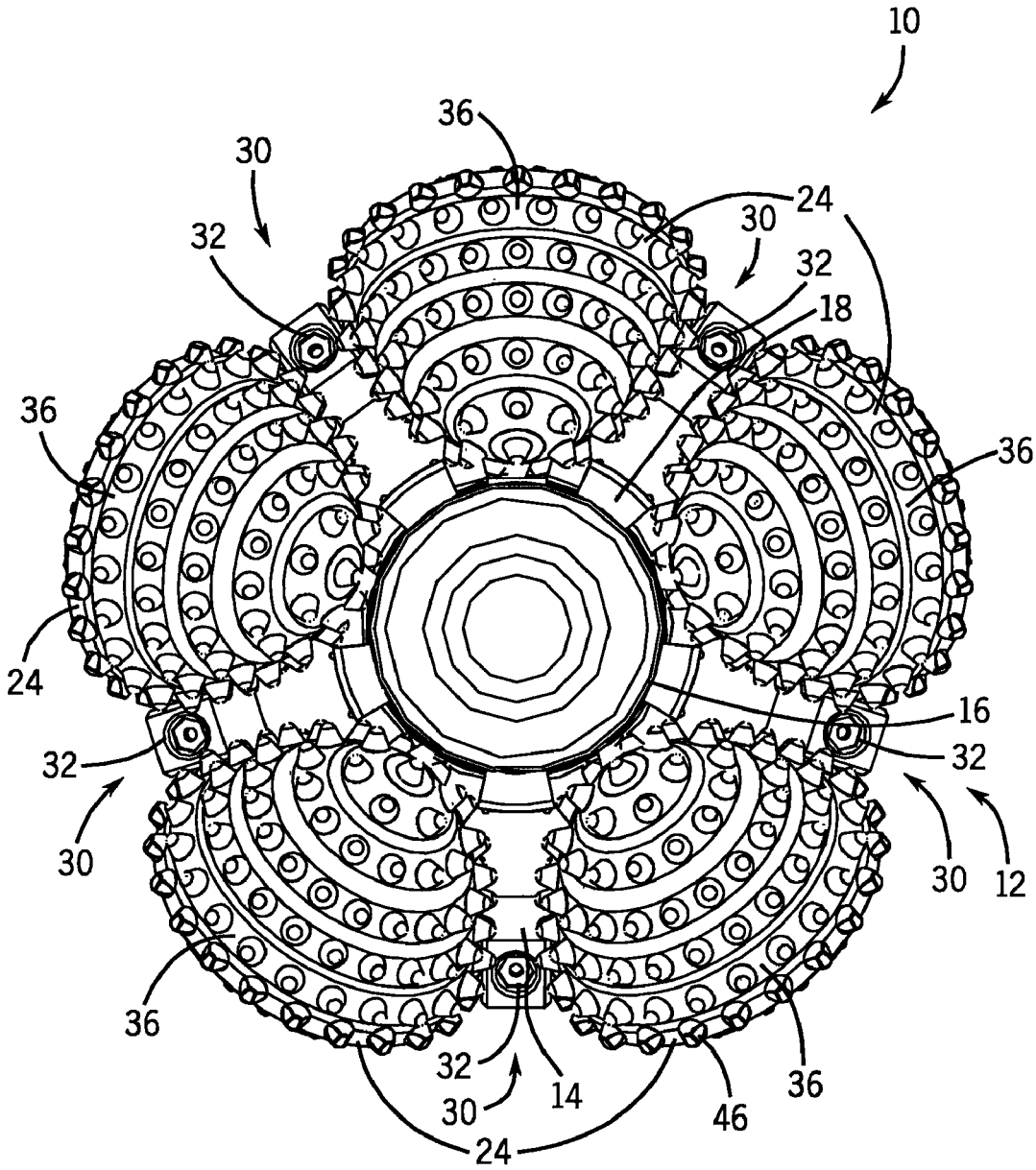
FIG. 2 is a front view of the hole opener assembly of FIG. 1.
Figure 3:
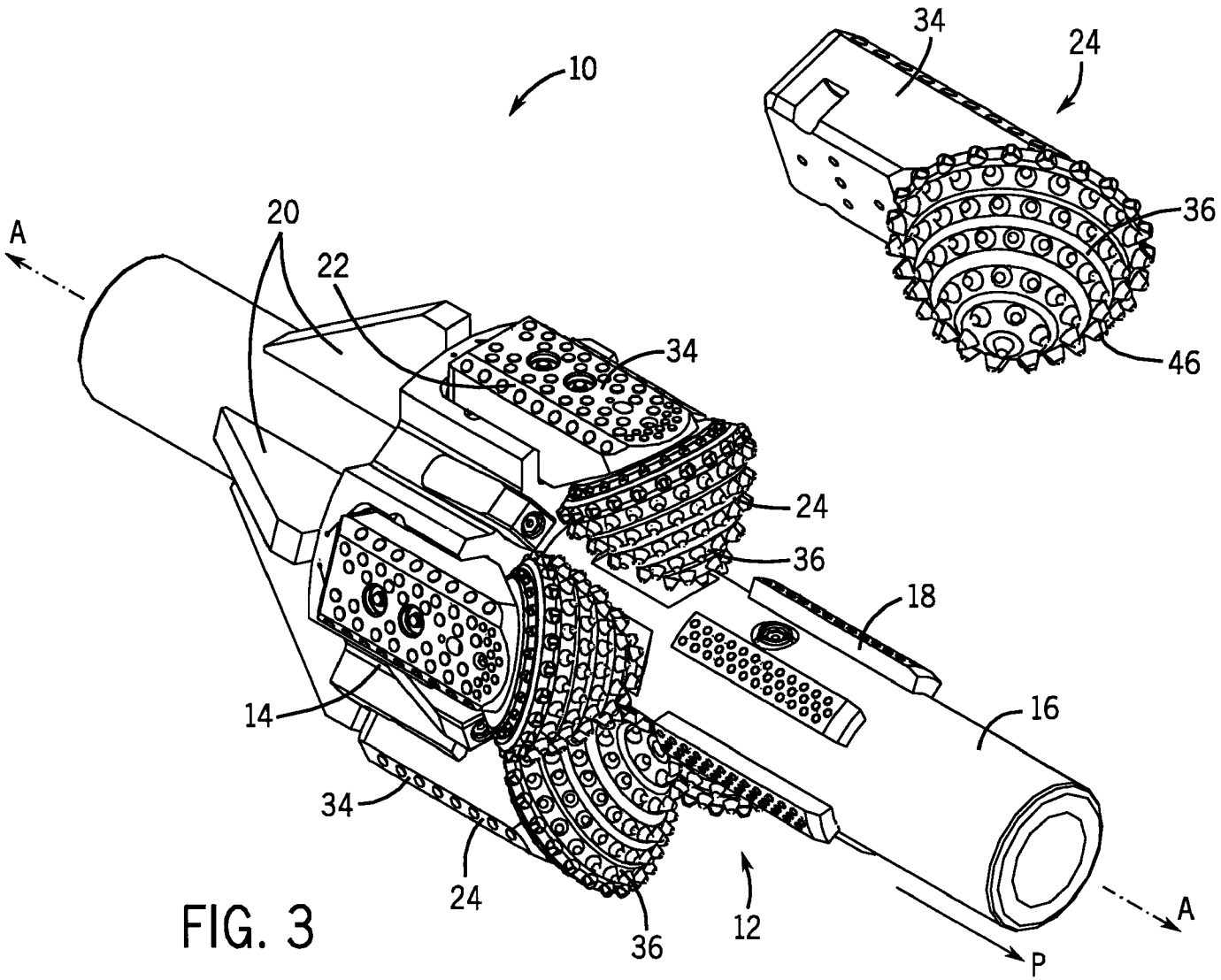
FIG. 3 is a perspective view of the hole opener assembly with one of the cone arms exploded from the bit body.
Figure 4:
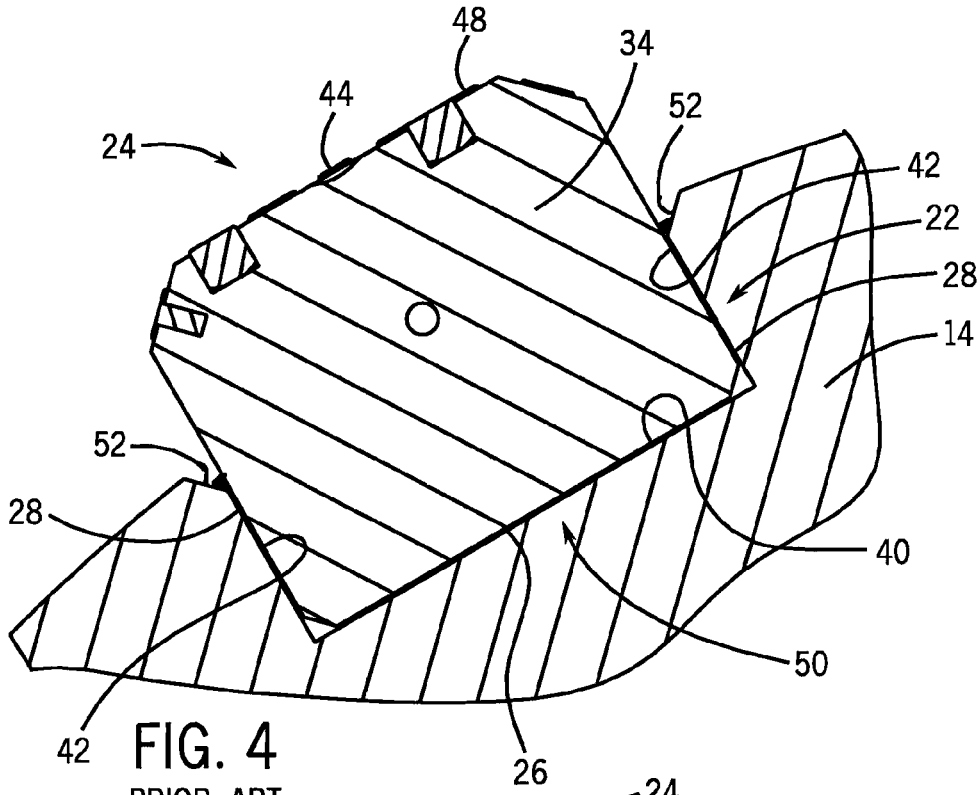
FIG. 4 PRIOR ART
FIG. 4 is a cross-sectional view of a prior art interface between a pocket and a cone arm taken along line 3-3.

Referring first to FIGS. 1-3, a hole opener assembly 10 is shown for pulling or pushing in a drill direction P. The hole opener assembly 10 includes a bit body 12 that extends along a rotational axis A-A which is parallel to the drill direction P. The bit body 12 has a solid body 14 with a shaft 16 extending axially therethrough. The shaft 16 is hardened (such as to approximately 40 HRC) and is welded to the solid body 14. A set of front stabilizers 18 and a set of rear stabilizers 20 extend from the shaft 16 to the solid body 14 to increase the strength of the bit body 12. The front stabilizers 18 and the rear stabilizers 20 are generally fin-shaped.

With additional reference to FIGS. 4-10, the solid body 14 has a plurality of pockets 22 formed about its outer periphery. Each of the pockets 22 are adapted to receive one of a plurality of cone arms 24 as will be described in further detail below. The pockets 22 are evenly angularly spaced about the rotational axis A-A of the bit body 12. Preferably, when the rear stabilizers 20 are present, they abut one of the pockets 22 to provide structural reinforcement for the pocket 22 when the pocket 22 is subjected to stress during the drilling operation.

The pockets 22 are generally concavely shaped and are formed in the outer surface of the bit body 12. Each pocket 22 has at least a base wall 26 and a side wall 28. The base wall 26 is a generally radially outward facing wall, although as will be described in further detail below, features may be formed in the base wall 26 to reduce break out failures. The side wall 28 of the pocket 22 is generally U-shaped. The U-shape of the side wall 28 has two legs extending in a direction parallel to the axis A-A with the bottom of the "U" angularly extending between the two legs on the side of the solid body 14 opposite the drill direction P.

Although the side wall 28 of the pocket 22 has been described as U-shaped, the shape does not need to be strictly U-shaped and variations to the shape are contemplated. For example, the side wall 28 could comprise three linear wall segments that are perpendicular to one another to form a U-like shape. Alternatively, there could be additional linear wall segments or curved wall segments that comprise portions of the side wall 28. In still another form, the side wall 28 of the pocket 22 could form a closed loop around the base wall 26.

Other variations in the pockets 22 are also contemplated. The pockets 22 are preferably integrally formed with the solid body 14, but could also be separately formed and attached via welding or the like. The pockets 22 could be defined by a two-sided wall of a desired thickness or could be formed as a recess in the volume of the solid body 14. In the form shown, there are five pockets 22 formed about the bit body 12, however in other forms there could be more or fewer pockets.

Between each of the pockets 22, channels 30 are formed. These channels 30 provide a path for the rearward removal of the debris created during the drilling operation.

Each of these channels 30 includes a carbide jet 32 that assists in the removal of the debris. Additional carbide jets may be formed around an outwardly facing radial surface of the shaft 16 located upstream of the pockets 22.

Figure 10:
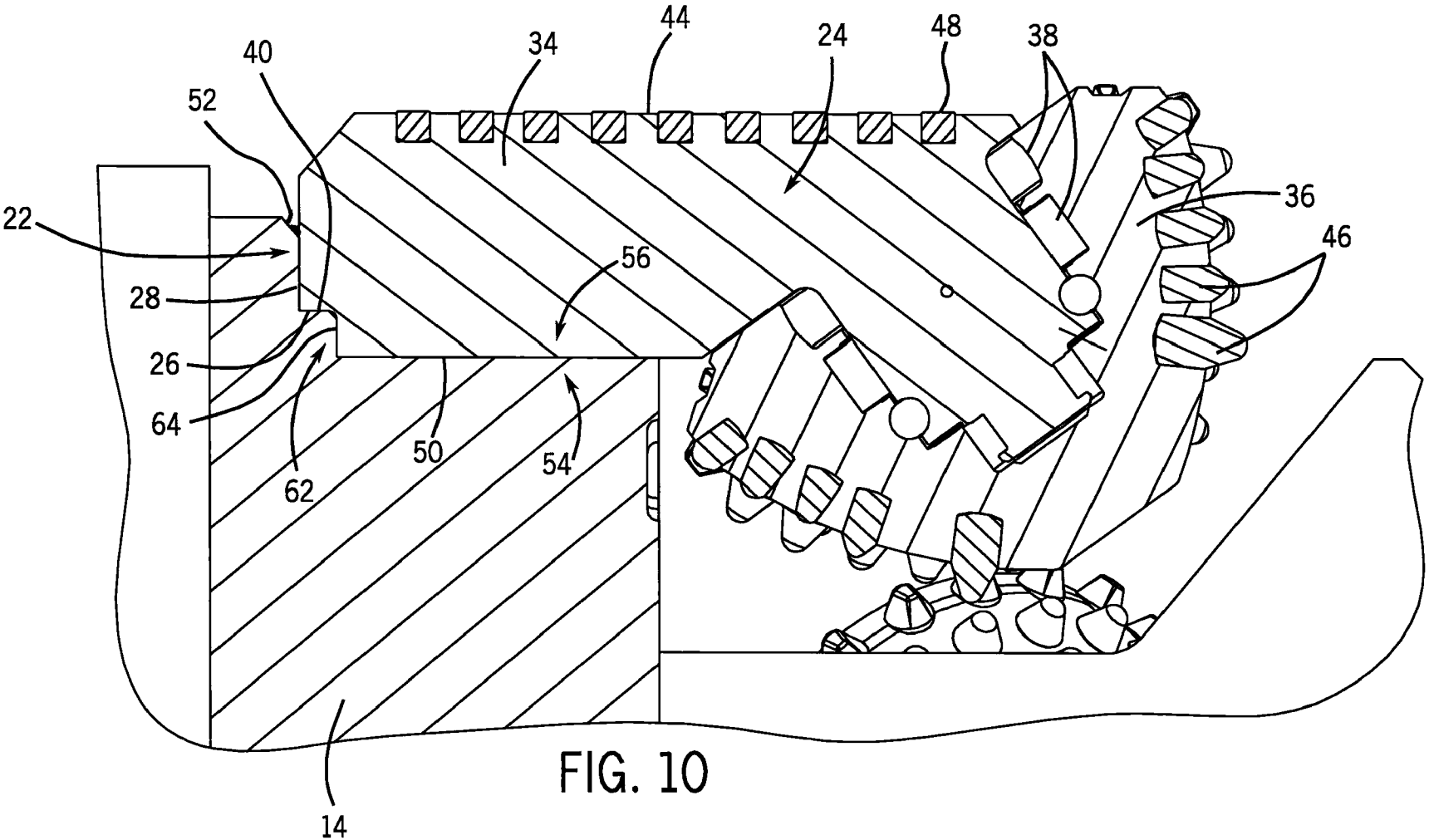
FIG. 10 is a cross-sectional side view of an interface between the pocket and cone arm in which a step is formed between the rear portion of the side wall and the base wall.

Each of the cone arms 24 include an arm 34 mounted into one of the pockets 22 and a rotatable cone head 36 attached to the arm 34. As best seen in FIG. 10, the connection between the arm 34 and the cone head 36 can include bearings 38 or the like to allow the rotation of the cone head 36 relative to the arm 34. The cone head 36 has a plurality of teeth 46 formed thereon for cutting. The arm 34 also includes a radially outward facing wall 44 with cutting teeth 48 for assisting in opening the hole.

In the form shown, each of the cone heads 36 or portions thereof rotate relative to the arm 34 along an axis of rotation that is not parallel with rotational axis A-A. Each of the rotational axes of the cone heads 36 intersect at a common point along the rotational axis A-A. Of course, the cone heads 36 may have rotational axes that differ from this configuration or that are parallel to rotational axis A-A.

Referring back to FIGS. 4-10, the arm 34 has a form with at least a portion that matches the form of the pocket 22. The arm 34 has a base wall 40 that corresponds to the base wall 26 in the pocket 22 and a side wall 42 that corresponds to the side wall 28 of the pocket 22.

To secure each of the cone arms 24 relative to the bit body 12, each of the cone arms 24 is welded into one of the pockets 22 on the bit body 12. More specifically, the arm 34 of the cone arm 24 is inserted into the pocket 22 and a weld is formed around a periphery of an interface 50 between the cone arm 24 and the pocket 22. Preferably, the weld is a multi-pass weld for added strength. As can be best seen in FIGS. 4-7 and 9, the side wall 28 of the pocket 22 may have a beveled edge 52 that helps to control the weld pool.

Further, other forms of securing the cone arms 24 in the bit body 12 may be used including, alone or in combination, welding, fastening, bolting, and the like.

In general operation, the hole opener assembly 10 is used in the following manner. A pilot hole is drilled along the desired horizontal drilling path by another drill tool. Then, the hole opener assembly 10 is pulled and/or pushed back through the pilot hole in the drill direction P. As the hole opener assembly 10 is pulled and/or pushed back through the pilot hole, the hole opener assembly 10 is rotated about the rotational axis A-A, causing the cone heads 36 to cut the area around the pilot hole. The cone heads 36 rotate as their teeth 46 perform the cutting action. The teeth 48 on the radially outward facing wall 44 of the arm 34 further assist in shaping the hole. Any cutting debris flows rearward through the channels 30, preferably assisted by the carbide jets 32.

During the drilling operation, the cone arms 24 are typically subjected to great stresses, often causing the cone arms 24 to break out of the pockets 22. Often this has resulted in failure in the side wall 28 of the pocket 22 or along the weld line. In many of the hole openers in which such failures are common, the arm 34 and pocket 22 are mated at an interface 50 similar to the one shown in FIG. 4.

However, it has found that the rate of break out failures or side wall fracture can be reduced by altering the interface 50 between the arm 24 and the pocket 22 to include a slot 54 and a key 56. Some examples of these improved interfaces for hole openers are shown in FIGS. 5-10.

Figure 5:
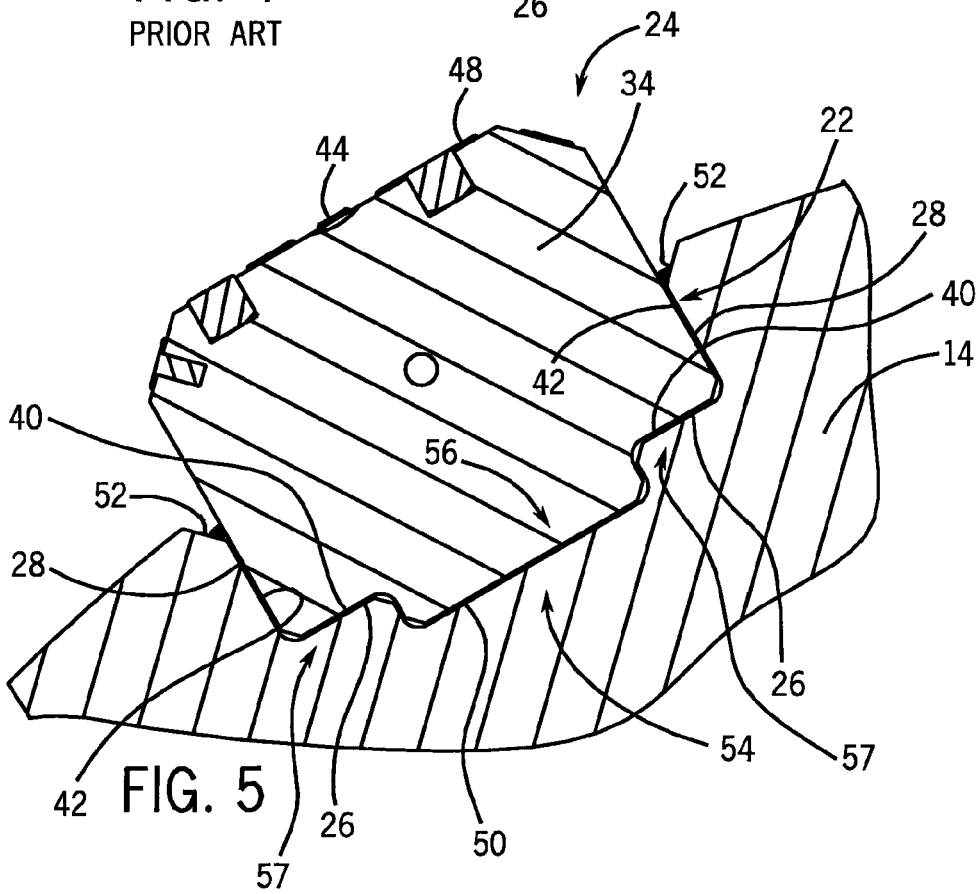
FIG. 5 is a cross-sectional view of one form of the improved stepped interface between a pocket and a cone arm in which there are two stepped sections.

FIG. 5 illustrates one form of a stepped interface. The pocket 22 and the arm 34 have the slot 54 and the key 56, respectively, formed therein along the interface 50 proximate the base walls 26 and 40. The key 56 and the slot 54 extend axially along the arm 34 and the pocket 22, respectively, with stepped portions 57 located along the interface 50 on either side of the key 56 and slot 54.

During insertion of the arm 34 into the pocket 22, the key 56 on the arm 34 fits into the slot 54 in the pocket 22. Notably, the fit between the key 56 and slot 54 is much tighter than the fit between the rest of the arm 34 and the pocket 22.

While a tighter fit exists between the key 56 and the slot 54 as compared to the arm 34 and pocket 22, the precise direction in which the fit is tighter may vary as may the form of the key and slot. For example, the side or lateral walls of the key 56 and slot 54 extend radially from the rotational axis A-A. Alternatively, the key 56 and slot 54 could be essentially rectangular in shape, as this form is easier to machine. Of course, geometric forms for the key 56 and slot 54 other than rectangular are contemplated. For example, the key 56 and slot 54 could be semi-circular, triangular, and the like and could also have edges that are beveled, radiused, and the like.

When a force is applied to cone arm 24, the stress is directed to the key 56 and the slot 54 region of the interface 50. Advantageously, this reduces the stress applied to the side wall 28 of the pocket 22. Surprisingly, it has been found that directing the stresses to the region of the key 56 and slot 54 via the tighter fit reduces the amount of breakout failures in which the cone arm 24 is fractured from the pocket 22 during the drilling operation.

Figure 6:
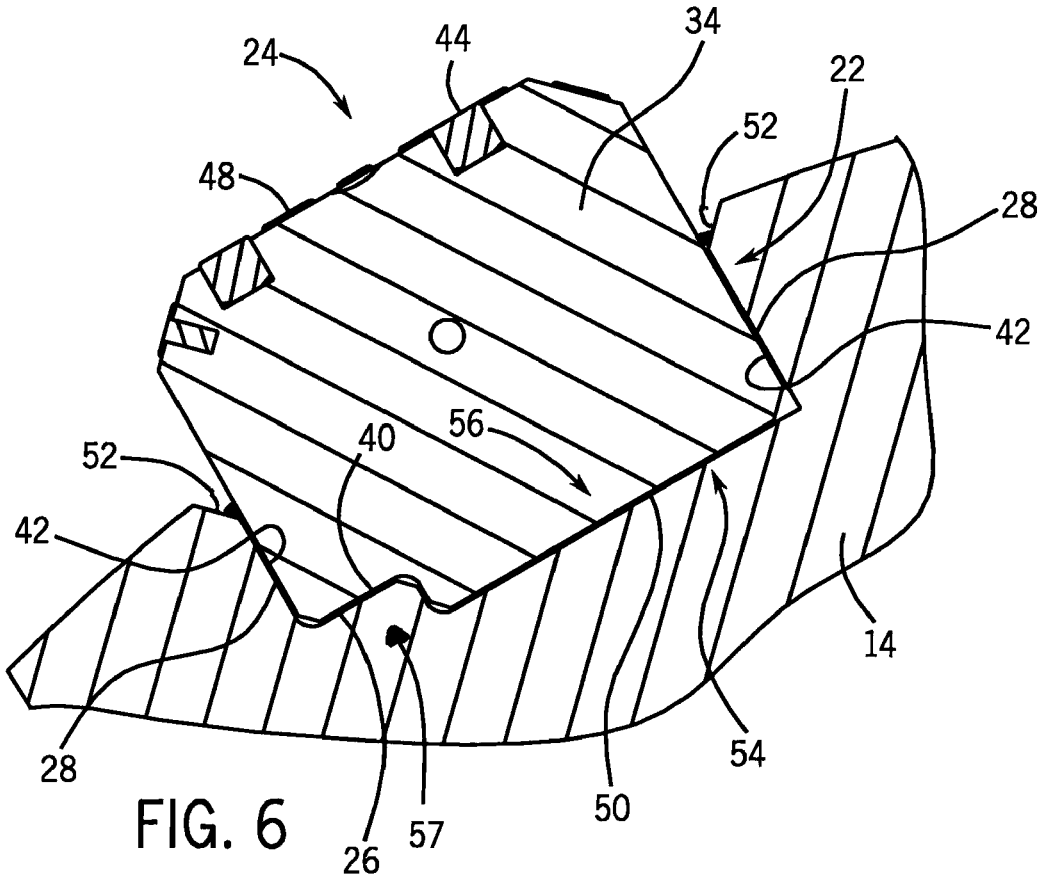
FIG. 6 is a cross-sectional view of another form of the improved interface between a pocket and a cone arm in which there is a single stepped section.
Figure 7:
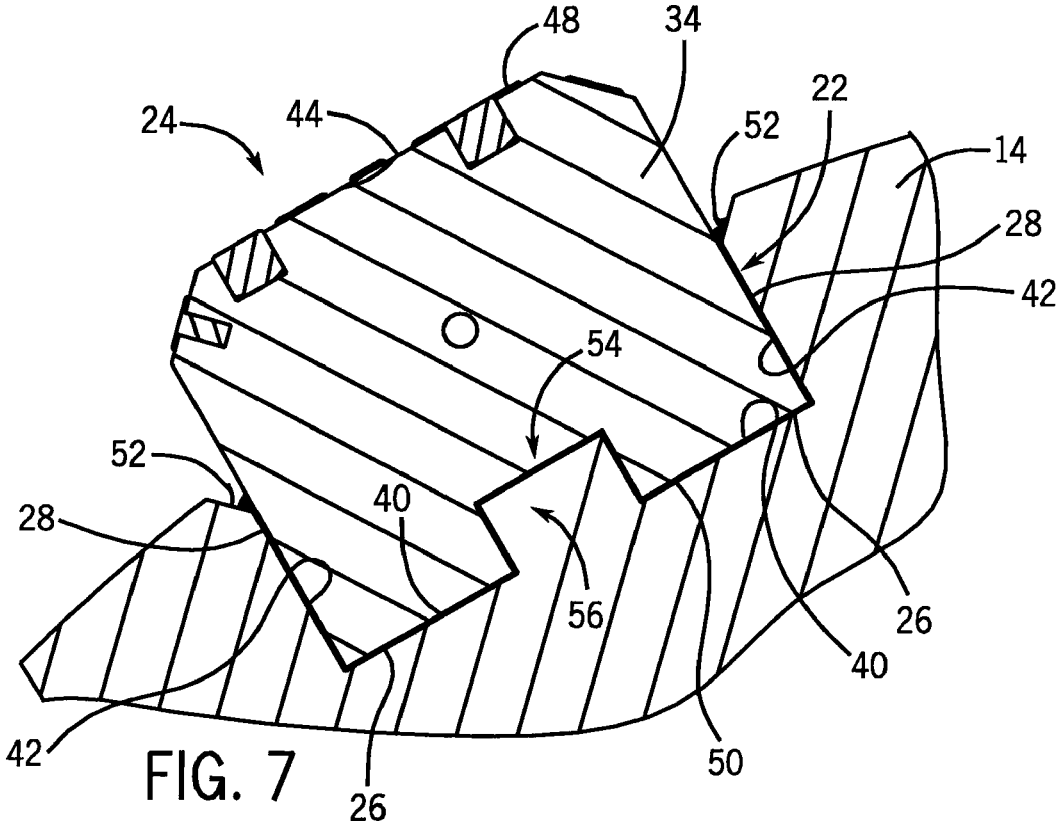
FIG. 7 is a cross-sectional view of yet another form of the improved interface between the pocket and the cone arm in which a key is formed in the pocket and a slot is formed in the arm.
Figure 8:
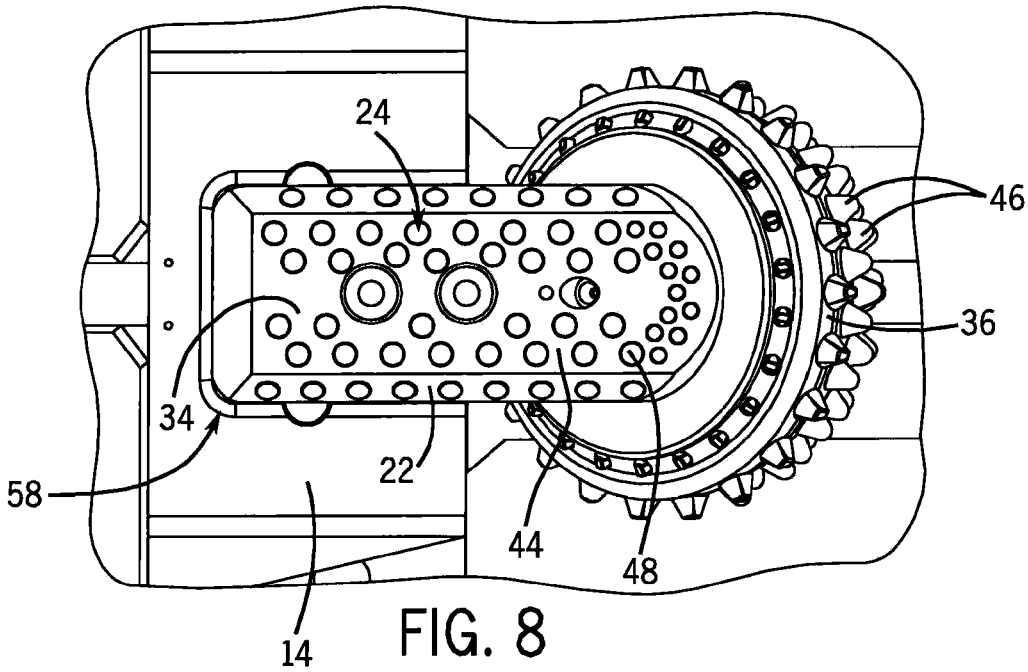
FIG. 8 is a plan side view of one of the cone arms attached to the bit body in which a rear portion of the side wall of the pocket and the cone arm have a curved segment.

Other alternative forms of the key 56 and slot 54 structure are shown in FIGS. 6 and 7.

In the form shown in FIG. 6, one of the stepped portions 57 is eliminated, enlarging the key 56 and slot 54. In this form, the key 56 and slot 54 extend from the stepped portion 57 on one side of the side wall 28 on the other side of the side wall 28 without a stepped portion.

In the form shown in FIG. 7, the key 56 and slot 54 have been formed on opposite members as compared to FIG. 5. The key 56 has been formed on the base wall 26 of the pocket 22 and the slot 54 has been formed on the corresponding base wall 40 of the arm 34.

Other variations can be made along the interface 50 between the arm 34 and the pocket 22. For instance, in FIG. 8, the portion of the side wall 28 of the pocket 22 opposite the drilling direction (i.e., the bottom of the "U") may have a curved shape as opposed to the original linear profile shown as dotted lines 58. Accordingly, the corresponding portion of the side wall 42 of the arm 34 is curved to match.

Figure 9:
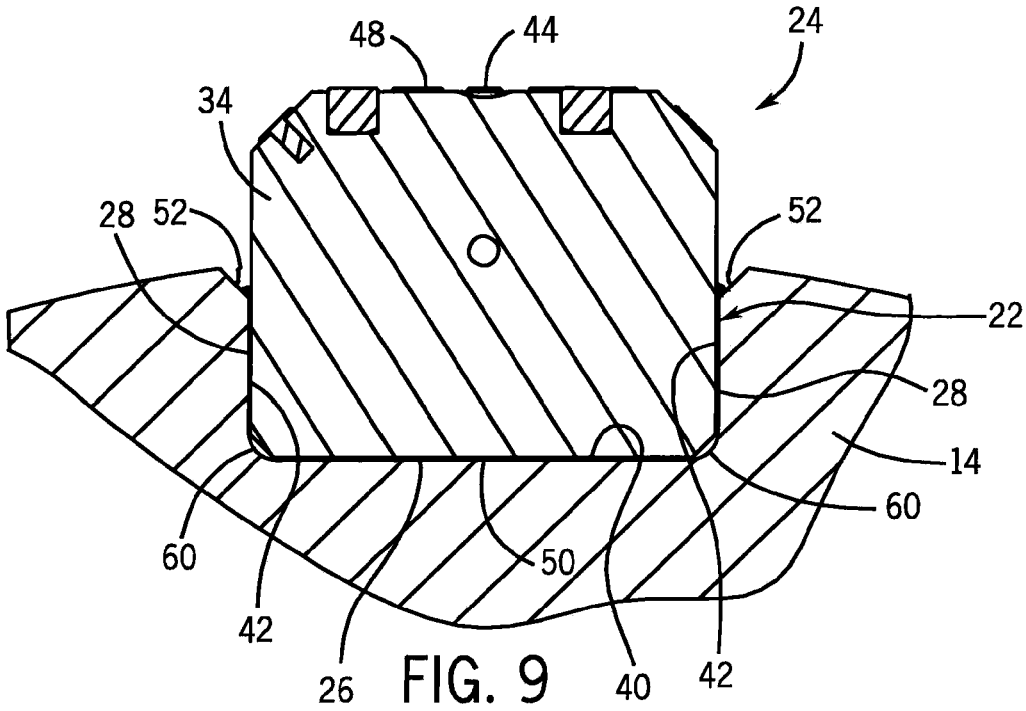
FIG. 9 is a cross-sectional view of an interface between the pocket and the cone arm in which an edge having a radius is formed between the side wall and the base wall of the pocket.

As in FIG. 9, many of an internal edges of the pocket 22 may have a radius 60 formed therein to better distribute stresses during operation. Although not shown in FIG. 9, this radius 60 may be combined with the key 56 and slot 54 structures described herein.

Referring now to FIG. 10, a rear step 62 is shown formed between the bottom of the side walls 28 and 42 (opposite the drilling direction P) and the base wall 26 and 40. This rear step 62 may be combined with any of the previously described key 56 and slot 54 type structures described above. This rear step 62 is formed in such a way that applied stress is first directed at the radially extending wall 64 of the rear step 62 at the interface 50 proximate the key 56 and slot 54. This reduces the stress at on the back portions of the side walls 28 and 42 (e.g., the bottom of the "U"), again reducing the likelihood of cone arm break out failure or pocket fracture.

It is also contemplated that the use of keys and slots or other such matching features could be used to ensure that the proper cone arm is being inserted into the pocket of the bit body. The key and slot could be formed in such a way that a cone arm that is not suitable for use in the bit body could not be fully inserted and secured into the pocket. The non-fitting cone arm could be improper for a number of reasons including that the arm is not properly graded for the drilling application or is made of a material not suitable for welding to the material of the bit body.

Further, although the key and slot have been shown as being integrally formed with the arm and the pocket, it is contemplated that a separate key could be formed that engages slots formed in both the arm and the pocket. If the key is a separate item, then the slots and key still have a tighter fit than between the arm and the pocket. It is contemplated that is some forms a separate key could be press fit into one or both of the slots form in the arm and pocket.

Thus, the present invention provides a hole opener assembly that is less prone to break out type failures in which the cone arm is fractured from the bit body or in which the side wall of the pocket is fractured. The reduction in failures minimizes the likelihood of downtime to repair and/or rebuild a damaged hole opener.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A hole opener assembly comprising:

a bit body extending along a rotational axis;

a plurality of pockets formed in the bit body, each of the pockets having a wall defining at least a portion of the pocket;

a plurality of cone arms, each of the plurality of cone arms having an arm mounted in one of the plurality of pockets to form a plurality of interfaces, each of the plurality of cone arms further including a cone head attached to the arm;

at least one of the plurality of interfaces including a slot formed in one of the pocket and the arm;

a key formed in the other of the pocket and the arm, the key mating into slot;

wherein the key and the slot have a tighter fit therebetween than between the arm and the pocket and in which a force exerted on the arm is initially transferred across the key and the slot to reduce the force transferred to the wall of the pocket.

2. The hole opener assembly as in claim 1, wherein each of the plurality of cone arms is welded into the plurality of pockets.

3. The hole opener assembly as in claim 1, wherein the slot and key have a form that prevents the mounting of improperly selected cone arms into the pocket.

4. The hole opener assembly as in claim 1, wherein each of the plurality of pockets formed in the bit body includes a radially outward facing wall and a radially extending U-shaped side wall.

5. The hole opener assembly as in claim 1, wherein a plurality of channels are formed between the plurality of pockets.

6. The hole opener assembly as in claim 5, further comprising at least one nozzle in one of the plurality of channels.

7. The hole opener assembly as in claim 1, wherein at least one of the slot and the key have an edge with a radius.

8. The hole opener assembly as in claim 1, wherein at least one of the key and the slot are formed in a radially outward facing surface of the bit body.

9. The hole opener assembly as in claim 1, wherein the key and slot extend essentially radially relative to the bit body.

10. The hole opener assembly as in claim 1, wherein the tighter fit between the key and slot as compared to between the arm and pocket is in an angular direction about the rotational axis.

11. The hole opener assembly as in claim 1, wherein the tighter fit between the key and slot as compared to between the arm and pocket is in a direction perpendicular to a radial direction.

12. The hole opener assembly as in claim 1, wherein the tighter fit between the key and the slot prevents the arm from contacting the pocket in an unstressed position.

13. The hole opener assembly of claim 1, wherein the slot is formed in a base wall of pocket and the key is formed in a corresponding base wall of the arm.

* * * * *